US009076627B2

(12) United States Patent
Yanagisawa et al.

(10) Patent No.: US 9,076,627 B2
(45) Date of Patent: Jul. 7, 2015

(54) RADIATION GENERATING APPARATUS AND RADIATION IMAGING APPARATUS USING THE SAME

(75) Inventors: Yoshihiro Yanagisawa, Fujisawa (JP); Kazuyuki Ueda, Tokyo (JP); Miki Tamura, Kawasaki (JP); Shuji Aoki, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 102 days.

(21) Appl. No.: 13/523,119

(22) Filed: Jun. 14, 2012

(65) Prior Publication Data

US 2013/0016812 A1 Jan. 17, 2013

(30) Foreign Application Priority Data

Jul. 11, 2011 (JP) ..... 2011-152792

(51) Int. Cl.

| | |
|---|---|
| ***H01J 35/16*** | (2006.01) |
| ***H01J 35/18*** | (2006.01) |
| ***G21K 1/02*** | (2006.01) |
| ***H01J 35/08*** | (2006.01) |

(Continued)

(52) U.S. Cl.

CPC ..... *H01J 35/16* (2013.01); *H01J 35/18* (2013.01); *G21K 1/02* (2013.01); *H01J 35/08* (2013.01); *H01J 35/14* (2013.01); *H05G 1/06* (2013.01); *H01J 2235/087* (2013.01); *H01J 2235/168* (2013.01)

(58) Field of Classification Search

CPC ..... H01J 35/16; H01J 2235/168; H01J 2235/087; G21K 1/02

USPC ..... 378/140–142, 138

See application file for complete search history.

(56) References Cited

U.S. PATENT DOCUMENTS

| | | | | |
|---|---|---|---|---|
| 3,334,256 | A * | 8/1967 | Gager | 378/140 |
| 4,543,207 | A * | 9/1985 | Sato et al. | 252/570 |

(Continued)

FOREIGN PATENT DOCUMENTS

| | | |
|---|---|---|
| JP | 2007-080568 | 3/2007 |
| JP | 2007-265981 | 10/2007 |

OTHER PUBLICATIONS

Miyazaki et al. (WO2011/105035). Radioactive Ray Generating Apparatus and Radioactive Ray Imaging System. Sep. 1, 2011.*

(Continued)

*Primary Examiner* — David J Makiya
*Assistant Examiner* — Danielle Fox
(74) *Attorney, Agent, or Firm* — Fitzpatrick, Cella, Harper & Scinto

(57) ABSTRACT

A radiation generating apparatus 30 according to the present invention including: a radiation generating tube 10 having a target 14, a tubular shielding member 18 that shields a part of a radiation generated from the target 14 and also has an aperture 21 through which the radiation generated from the target 14 passes, and an envelope 1 that has the target 14 so as to be brought into contact with the internal space thereof and also has the tubular shielding member 18 so as to protrude toward an external space thereof; a storage container 1 for storing the radiation generating tube 3 therein; and an insulating liquid 8 that comes in contact with the tubular shielding member 18 and the storage container 1, wherein the tubular shielding member 18 has a protruding portion P, and the protruding portion P is covered with a solid insulating member 9.

15 Claims, 5 Drawing Sheets

(51) Int. Cl.
*H01J 35/14* (2006.01)
*H05G 1/06* (2006.01)

(56) References Cited

U.S. PATENT DOCUMENTS

| | | | | |
|---|---|---|---|---|
| 8,139,716 | B2 | 3/2012 | Okunuki et al. | 378/122 |
| 2005/0257404 | A1* | 11/2005 | Daza | 36/72 R |
| 2009/0010393 | A1 | 1/2009 | Klinkowstein et al. | 378/140 |
| 2009/0316860 | A1* | 12/2009 | Okunuki et al. | 378/122 |
| 2012/0318987 | A1* | 12/2012 | Miyazaki et al. | 250/358.1 |

OTHER PUBLICATIONS

JPO Office Action issued on Feb. 3, 2015, in counterpart Japanese Patent Application 2011-152792, with partial translation.

* cited by examiner

RADIATION GENERATING APPARATUS AND RADIATION IMAGING APPARATUS USING THE SAME

BACKGROUND OF THE INVENTION

1. Field of the Invention

The present invention relates to a radiation generating apparatus which can be applied to non-destructive X-ray imaging or the like in a medical equipment field and an industrial equipment field, and to a radiation imaging apparatus using the same.

2. Description of the Related Art

Generally, a radiation generating tube accelerates electrons to be emitted from an electron emitting source by high voltage, and makes the accelerated electrons irradiate a target including a metal such as tungsten to make the target generate radiation such as X-rays. The radiation which has been generated at this time is emitted toward all directions. Japanese Patent Application Laid-Open No. 2007-265981 discloses a transmission-type radiation generating tube which has a shielding member arranged in an electron-incident side and a radiation-emitting side of the target, so as to shield radiation that heads toward directions other than a necessary direction. Such a transmission-type radiation generating tube does not need to cover the whole periphery of the radiation generating tube or a storage container for storing the radiation generating tube with a shielding member such as lead, and accordingly can achieve the reduction of the size and weight of the apparatus.

Incidentally, in order to generate radiation suitable for radiation imaging, a high energy electron beam needs to be emitted by applying a high voltage of 40 kV to 150 kV between the electron emitting source and the target. Because of this, a high potential difference of several tens kV or more results in being generated between the electron emitting source and the target, and between the radiation generating tube and the storage container. Japanese Patent Application Laid-Open No. 2007-80568 discloses such a structure that an insulating oil is filled between the radiation generating tube and the storage container 1, and further such a structure that an insulating member is arranged in the storage container 1, as a unit for securing voltage withstanding against the high voltage as described above.

In the above described transmission-type radiation generating tube, a middle-point grounding method is adopted as a voltage applying unit, and accordingly the size and weight of the radiation generating apparatus can be further reduced. Here, the middle-point ground method is a method of setting a potential with respect to the GND earth of the target at $+(Va-\alpha)$ [V], and a potential with respect to the GND earth of the electron emitting source at $-\alpha$ [V] (however, $Va>\alpha>0$), respectively. The value of $\alpha$ is an arbitrary value within a range of $Va>\alpha>0$, but generally is a value close to $Va/2$. When such a middle-point grounding method is adopted, the absolute value of the voltage with respect to the ground becomes small, and a creepage distance necessary for securing the voltage withstanding properties can be shortened. Accordingly, the size and weight of the apparatus can be reduced.

On the other hand, high potential difference is generated between the shielding member which has been electrically connected with the target and a storage container 1 which is generally grounded to become a ground potential, and accordingly an insulating liquid is exposed to an electric-field concentrated region located in the vicinity of the end of the shielding member. In such an insulating liquid in the electric-field concentrated environment, such a problem has occasionally occurred that voltage withstanding is lowered as in the case that an electric discharge occurs between the shielding member and the storage container 1 which is set at the ground potential. Furthermore, there is the case in which an electric charge is transferred to the end of the shielding member from the insulating liquid in the periphery due to such an action of the electric field concentration. In this case, depending on a driving condition of the radiation generating apparatus, the insulating liquid occasionally deteriorates because of the denaturation of a component constituting the insulating liquid due to this electric charge transfer and the voltage withstanding has been occasionally lowered.

Japanese Patent Application Laid-Open No. 2007-80568 discloses that a cylindrical insulating sleeve for insulating high voltage and a cylindrical shielding body for shielding scattered X-rays are arranged in the peripheral portion of an X-ray emitting port on the external side face of an X-ray tube bulb, and that the whole of the insulating sleeve and the shielding body are immersed in the insulating oil. However, though Japanese Patent Application Laid-Open No. 2007-80568 discloses the radiation generating apparatus of middle-point grounding, the potential of the radiation emitting port is an approximately ground potential, and such a problem is hard to occur that an electric discharge is generated between the radiation emitting port and a storage container which is set at the same ground potential as that of the radiation emitting port. Furthermore, Japanese Patent Application Laid-Open No. 2007-80568 does not disclose a special reason why the place of the insulating member to be arranged is selected, and does not give a special suggestion for solving the above described problem.

For this reason, an object of the present invention is to provide a radiation generating apparatus in which a radiation generating tube is immersed in an insulating liquid in the inside of the storage container, and which achieves the enhancement of voltage withstanding against high voltage and the reduction of the size and the weight, and to provide a radiation imaging apparatus using the same radiation generating apparatus.

SUMMARY OF THE INVENTION

According to an aspect of the present invention, a radiation generating apparatus comprises: a radiation generating tube having a target, a tubular shielding member for shielding a part of a radiation generated from the target, and having an aperture through which the radiation passes, and an envelope holding the tubular shielding member to be protrude toward an external space thereof; and a container holding the radiation generating tube therein, and an insulating liquid contacting with the tubular shielding member and with the container, wherein the tubular shielding member has a protruding portion, and the protruding portion is covered with a solid insulating member.

The radiation generating apparatus according to the present invention has a structure in which a window provided in the storage container 1 that has the insulating liquid provided in its inside, and an aperture substrate of a tubular shielding member that is provided in the radiation generating tube arranged inside the storage container 1 are arranged so as to oppose to each other, and the end of the tubular shielding member in the substrate aperture 21 side is covered with the solid insulating member. In the radiation generating apparatus, a portion in which the electric filed is particularly concentrated in the end of the tubular shielding member is covered with a solid insulating member having electrostatic performance higher than that of the insulating liquid and having a high stability of the electrostatic performance. Accordingly, a radiation generating apparatus can be provided which suppresses an electric discharge between the radiation generating tube and the storage container 1, and is highly reliable. Furthermore, the radiation generating apparatus can shorten a distance between the radiation generating tube and the storage container, by the enhancement of the electric voltage withstanding, and accordingly can achieve also the reduction of its size and weight.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Embodiments according to the present invention will be described below with reference to the drawings, but the present invention is not limited to these embodiments. For information, a well-known or known art in the technical field shall be applied to a part which is not particularly illustrated or described in the present specification.

Figure 1A:
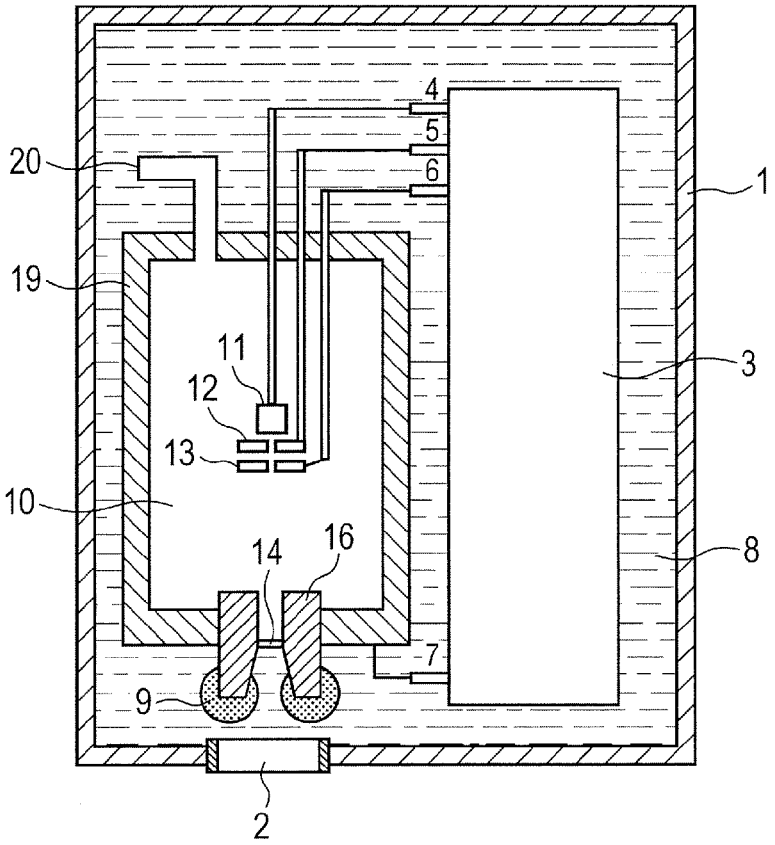
FIGS. 1A and 1B are schematic cross-sectional views of a radiation generating apparatus of an embodiment of the present invention.
Figure 1B:
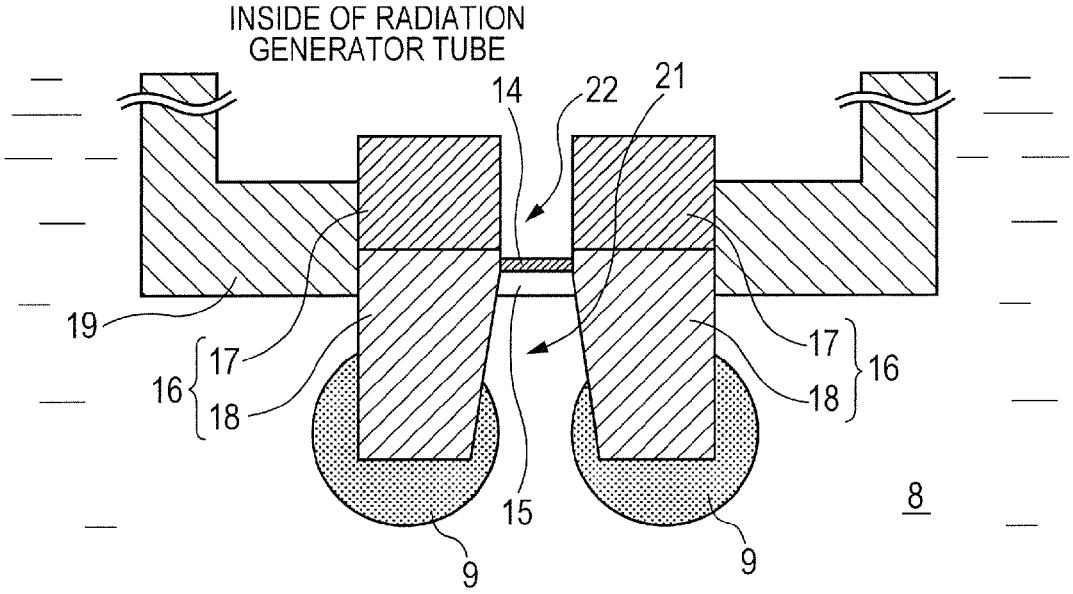

FIG. 1A is a schematic cross-sectional view illustrating one embodiment of a radiation generating apparatus of the present invention; and FIG. 1B is a schematic cross-sectional view in which the peripheral portion of the shielding member of FIG. 1A has been enlarged. The radiation generating apparatus of the present embodiment includes a transmission-type radiation generating tube 10, and this radiation generating tube 10 is stored in the inside of a storage container 1. An insulating liquid 8 is filled in a rest space except a space in which the radiation generating tube 10 is stored, in this storage container 1. A voltage controlling section 3 (voltage controlling unit) which includes a not-shown circuit board, an isolation transformer and the like may also be provided in the inside of the storage container 1, as in the present embodiment. When the voltage controlling section 3 is provided in the storage container 1, the voltage controlling section 3 applies a voltage signal to the radiation generating tube 10, for instance, through terminals 4, 5, 6 and 7, and thereby can control the generation of the radiation. In the present invention, the filling of the insulating liquid 8 not only means that the insulating liquid 8 is filled between the storage container 1 and the radiation generating tube 10 so as not to form a gap, but also includes that a gas such as air and nitrogen or a gap formed of a decompressed space and the like exists in the inside of the storage container 1, considering that stored components such as the voltage controlling section 3, the radiation generating tube 10 and the insulating liquid 8 which are arranged in the internal space of the storage container 1 expand or shrink because of the temperature change.

The storage container 1 may have a sufficient strength as a container, and is formed from a metal material, a plastic material or the like.

The insulating liquid 8 may have electrical insulation properties, and can employ, for instance, an electrically insulating oil having a role of an insulating medium and a cooling medium for the radiation generating tube 10. A mineral oil, a silicone oil, a perfluoro-series polymer oil and the like can be used as the electrically insulating oil. The insulating liquid 8 to be used other than the above oils includes an electrically insulating fluorine-series liquid.

A first window 2 through which the radiation passes and is extracted toward the outside of the storage container 1 is provided in the storage container 1. The radiation which has been emitted from the radiation generating tube 10 is emitted to the outside through this first window 2. Glass, aluminum, beryllium or the like is used for the first window 2.

The radiation generating tube 10 includes an envelope 19, an electron-emitting source 11, a target 14, a substrate 15, a shielding member 16 and an insulating member 9. An extraction electrode 12 and a lens electrode 13 may also be provided in the radiation generating tube 10, as in the present embodiment. When these components are provided, electrons are emitted from the electron-emitting source 11 by an electric field which is formed by the extraction electrode 12, and the emitted electrons are converged by the lens electrode 13, are incident on the target 14 and generate the radiation. In addition, an exhaust pipe 20 may also be provided, as in the present embodiment. When the exhaust pipe 20 is provided, the inside of the envelope 19 can be evacuated by sealing a part of the exhaust pipe 20, for instance, after the inside of the envelope 19 has been evacuated into a vacuum through the exhaust pipe 20.

The envelope 19 functions so as to keep the vacuum in the inside of the radiation generating tube 10. A glass material, a ceramic material or the like is used as the material. The degree of vacuum in the envelope 19 may be approximately $10^{-4}$ to $10^{-8}$ Pa. A not-shown better may also be arranged in the inside of the envelope 19 so as to keep the vacuum in the inside of the radiation generating tube 10. In addition, the envelope 19 has an aperture portion, and a shielding member 16 having an aperture 21 and an aperture 21 is bonded to the aperture portion. The envelope 19 is sealed by the bonding of a substrate 15 to the inner wall of the aperture 21 and the aperture 21 of this shielding member 16.

The electron-emitting source 11 is arranged in the inside of the envelope 19 so as to oppose to the target 14. The electron-emitting source 11 can employ a hot cathode such as a tungsten filament and an impregnated type cathode, or a cold cathode such as a carbon nanotube. The extraction electrode 12 is arranged in the vicinity of the electron-emitting source 11. The electrons which have been emitted by the electric field that is formed by the extraction electrode 12 are converged by the lens electrode 13, are incident on the target 14, and generate the radiation. At this time, a voltage Va which is applied between the electron-emitting source 11 and the target 14 is approximately 40 kV to 120 kV, though the voltage varies depending on the application to be used of the radiation.

The target 14 is in contact with the envelope 19 in such a way as to be exposed to the internal space of the envelope 19, and is arranged so as to oppose to the electron-emitting source 15. The target 14 is supported by the substrate 15 as needed.

In this case as well, the target 14 is arranged on the surface in the electron-emitting source side of the substrate 15. The material which constitutes the target 14 can be a material that has a high melting point and high radiation-generating efficiency. The usable materials include, for instance, tungsten, tantalum and molybdenum. The target 14 has suitably a thickness of approximately several μm to a dozen or so μm, in order to reduce the absorption of the radiation, which occurs when the generated radiation passes through the target 14.

The substrate 15 supports the target 14, passes at least one part of the radiation generated in the target 14, and is arranged at such a position as to oppose to a first window 2 in the aperture 21 and the aperture 21 of the shielding member 16. The material which constitutes the substrate 15 can be a material which has a strength enough to support the target 14, absorbs little radiation generated in the target 14, and has high thermal conductivity so as to be capable of quickly radiating a heat generated in the target 14. The usable materials include, for instance, diamond, silicon nitride and aluminum nitride. The substrate 15 has suitably a thickness of approximately 0.1 mm to several mm, in order to satisfy the above described requirements for the substrate 15.

The shielding member 16 has the aperture 21 and the aperture 21 which communicate with the substrate 15, shields unnecessary radiation out of the radiation emitted from the target 14, and is bonded to the aperture portion of the envelope 19. The substrate 15 is bonded to the inner walls of the aperture 21 and the aperture 21. The target 14 does not need to be bonded to the inner walls of the aperture 21 and the aperture 21. In the present invention, the shielding member 16 may protrude at least from the radiation generating tube 10 to the first window side. In addition, the shielding member 16 may include two shielding members (first shielding member 17 and second shielding member 18) formed of a pillar shape such as a cylindrical shape, as in the present embodiment.

The first shielding member 17 has a function of shielding radiation which have scattered in the electron-emitting source side of the target 14, protrudes to the electron-emitting source 11 side from the radiation generating tube 10, and has an electron-passing hole 22 which communicates with the substrate 15. The electrons which have been emitted from the electron-emitting source 11 pass through the electron-passing hole 22, and collide against the target 14. The radiation which has scattered to the electron-emitting source side of the target 14 out of the radiation that has been generated in the target 14 is shielded by the first shielding member 17.

The second shielding member 18 has a function of shielding unnecessary radiation out of the radiation which has passed through the substrate 15 and has been emitted, protrudes to the first window 2 side from the radiation generating tube 10, and has the aperture 21 and aperture 21 which communicate with the substrate 15. The radiation which has passed through the substrate 15 passes through the aperture 21 and the aperture 21, and the unnecessary radiation is shielded by the second shielding member 18.

The aperture area of the aperture 21 and the aperture 21 of the second shielding member 18, which communicate with the substrate 15, can become gradually large toward the first window 2 side from the substrate 15 as in FIG. 1B, from the viewpoint of extracting more radiation to the outside of the storage container 1. This is because the radiation which has passed through the substrate 15 spreads radially.

In addition, an aperture weight center of the first shielding member 17 in the target side of the electron-passing hole 22 can match an aperture weight center of the second shielding member 18 in the target side of the aperture 21 and the aperture 21. This is because the radiation which has been generated in the transmission-type target 14 by the irradiation with the electrons can be more surely extracted in a larger amount by an arrangement according to this way. The "aperture weight center" means a weight center supposed when assuming that the aperture portions have the same size and shape and the uniform thickness. For instance, when viewed from the electron-emitting source 11 side as in FIG. 1B, the aperture portion of the first shielding member 17 in the target side of the electron-passing hole 22 may be overlapped with the aperture portion of the second shielding member 18 in the target side of the aperture 21 and the aperture 21.

The material which constitutes the shielding member 16 can be a material which has high absorptivity for the radiation and high thermal conductivity. The usable materials include, for instance, a metal material such as tungsten and tantalum. The thicknesses of the first shielding member 17 and the second shielding member 18 are suitably 3 mm or more so as to shield the unnecessary radiation.

The target 14 is mechanically and thermally brought into contact with the first shielding member 17 and the second shielding member 18, directly or through the substrate 15. Because of this, the heat which has been generated in the target 14 is transferred to the second shielding member 18, is transferred to the insulating liquid 8 through the second shielding member 18, and is radiated. Therefore, a temperature rise of the target 14 is suppressed.

The radiation generating apparatus in the present invention includes that a protruding portion in an end of the second shielding member 18, precisely in a face of the second shielding member 18 (hereinafter referred to as "end face of second shielding member 18"), which opposes to the first window 2, is covered with a solid insulating member 9.

The protruding portion according to the present invention is a tip having a sharp cross section of the shielding member 18. Specific forms of the protruding portion of the shielding member 18 of the present invention include portions having a cone shape such as a conical shape and a polygonal pyramid shape which have a radius of curvature of 100 μm or less, and further include a ridge-shaped portion at which two faces share a vertex portion with an acute angle.

Figure 5:
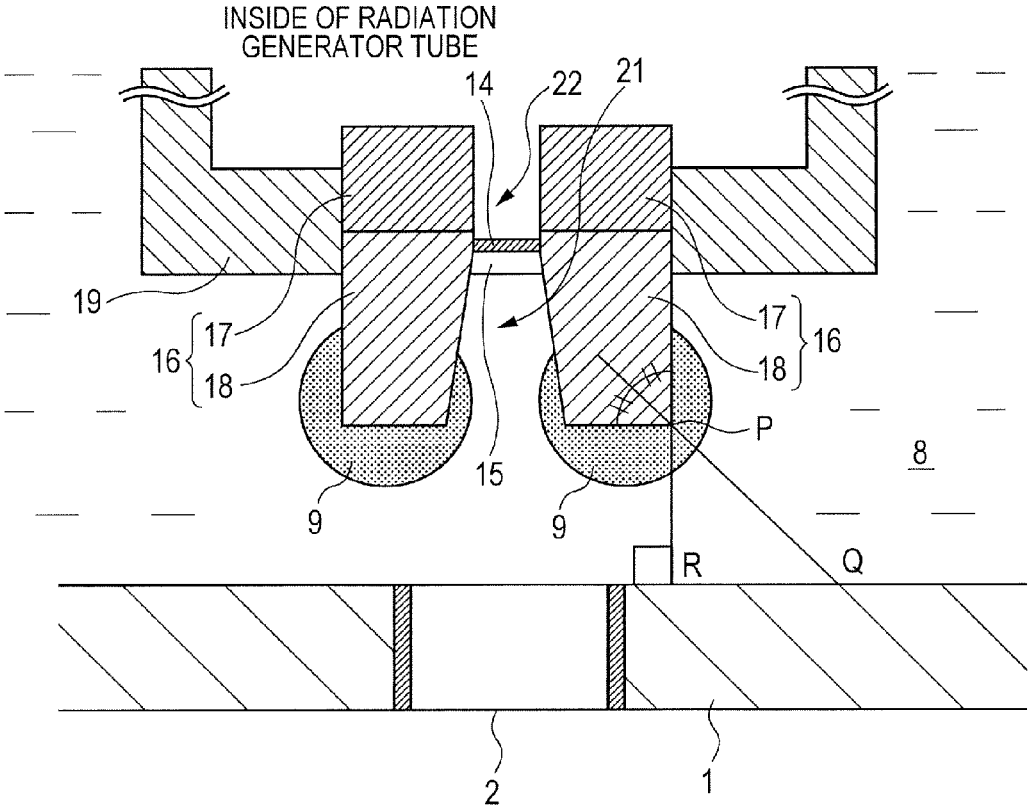
FIG. 5 is a schematic cross-sectional view of a peripheral portion of a shielding member of an embodiment of the present invention.

Furthermore, the radiation generating apparatus can acquire an electric-discharge suppressing effect due to the covering for a protruding portion P of the present invention with the insulating member 9 as is illustrated in FIG. 5, when the protruding portion is arranged in such a positional relationship that a distance PR between the protruding portion and the storage container is shorter than a distance PQ between a position at which a bisector of angle at the protruding portion intersects the storage container and the protruding portion, in a positional relationship between the protruding portion P and the storage container 1. The reason is assumed to be that in the case of the above described arrangement relationship (PR<PQ), the arrangement relationship becomes an arrangement relationship in which the concentration of an electric field generated between the window of the storage container and the protruding portion P increases, and accordingly that the covering for the protruding portion P with the insulating member 9 shows an effect of dispersing the concentration of the electric field.

It can be generally described that the electric field in the vicinity of the surface of the shielding member 18 depends on the material and the surface shape of the shielding member 18, emits electrons according to a phenomenon known as an F-N plot, and leads to the electric discharge. As a result of an extensive investigation, the present inventors found out that an electric-discharge suppressing effect was obtained by covering a tip of the shielding member 18 with a solid insulating member 9 so that the tip was connected to the inner part of the insulating liquid through the solid insulating member 9. In particular, the present inventors found out that when there was a region having a radius of curvature of 100 μm or less in the surface shape of the shielding member 18, the electric-discharge suppressing effect was obtained by covering the above described region with the solid insulating member 9, and that when there was a region having a radius of curvature of 30 μm or less in the shielding member 18, a further electric-discharge suppressing effect was obtained.

An "inner side protruding portion" and an "outer side protruding portion" of the shielding member of the present invention mean portions arranged in the inner side and the outer side of the shielding member so as to surround the aperture 21 of the tubular shielding member, out of the second shielding member. The "inner side protruding portion" of the second shielding member 18 is in a position that is a ridge-shaped boundary region between the inner wall of the aperture of the second shielding member 18 and a face on which the second shielding member 18 opposes to the inner wall of the storage container 1, and annularly surrounds the aperture 21. In correspondence with this, the "outer side protruding portion" is in a position that is a ridge-shaped boundary region between the outer wall of the second shielding member 18 and a face on which the second shielding member 18 opposes to the inner wall of the storage container 1, and annularly surrounds the aperture 21 in a more outer side than the "inner side protruding portion". From the viewpoint of securing voltage withstanding properties between the second shielding member 18 and the storage container 1, the thicknesses in the inner side protruding portion and the outer side protruding portion of the insulating member 9 on the end face of the second shielding member 18 are suitably approximately 0.1 mm to 10 mm.

The material which constitutes the insulating member 9 can be a material that is a solid having high electrical insulation properties and high heat resistance, and an inorganic material or an organic material can be applied to the material. The usable inorganic materials include diamond, glass, silicon nitride, aluminum nitride and aluminum oxide. The organic materials include a glass epoxy, an epoxy resin and a polyimide resin. The insulating member 9 may also employ a material having higher electrical insulation properties than those of the insulating liquid 8. A method of mounting the insulating member 9 includes bonding by an adhesive and mechanical screwing. When the insulating member 9 is a resin material, the insulating member may be directly formed on the inner side protruding portion and the outer side protruding portion of the end face of the second shielding member 18. The insulating member 9 may have sufficiently higher resistance than the electroconductivity which the second shielding member 18 and the storage container 1 have, and a material having a resistivity of $1\times10^5$ Ωm (room temperature) or more can be applied to the insulating member 9. In addition, a material having a specific dielectric constant (room temperature, 1 MHz) of 40 or less can be applied to the insulating member 9, and a material further having a specific dielectric constant of 10 or less can be applied to the insulating member 9.

Furthermore, the insulating member 9 can further have a higher resistivity than that of the insulating liquid 8 and have a lower specific dielectric constant than that of the insulating liquid 8, from the viewpoint of electric field relaxation in the vicinity of the protruding portion.

In a potential distribution in the insulating liquid 8 between the second shielding member 18 which is set at a high potential and the storage container 1 (including first window 2) which is set at a ground potential, the electric-field concentration may occur on the ends of the second shielding member 18. Out of the ends of the second shielding member 18, particularly in the inner side protruding portion and in the outer side protruding portion on the end face of the second shielding member 18, the electric-field concentration may occur. This is because the inner side protruding portion and the outer side protruding portion on the end face of the second shielding member 18 have a sharp shape. In the present invention, the inner side protruding portion and the outer side protruding portion on the end face of the second shielding member 18, particularly on which the electric field concentration may occur, are covered with the solid insulating member 9, and accordingly the enhancement of electrical voltage withstanding and the prevention of deterioration of the insulating liquid 8 can be achieved. The insulating liquid such as an electrically insulating oil has generally high electrical insulation properties and voltage withstanding properties, but the voltage withstanding properties occasionally deteriorate due to impurities, a water content, air bubbles and the like which are contained in the insulating liquid or are produced due to time degradation. In addition, an electric discharge becomes easily generated due to the deposition and adhesion of a denatured substance and contamination onto the tip portion of the second shielding member 18, which are caused by the influence of fluidity (convection and ion migration) of the insulating liquid. Because of this, the case in which an electric-field concentration point (sharp portion like the end of the shielding member) is occupied by a dielectric material formed of a non-flowable solid material is more adequate in the point of voltage withstanding reliability and can be more surely kept high voltage withstanding properties, than the case in which the electric-field concentration point is occupied by a dielectric formed of a fluid member such as an insulating liquid. In the present invention, a creepage distance which will be described later can be shortened by the enhancement of electrical voltage withstanding, and the reductions of the size and weight can be achieved. Accordingly, the voltage withstanding properties can be secured for a long period of time, and accordingly a radiation generating apparatus having higher reliability can be achieved.

Incidentally, in FIGS. 1A and 1B, a region surrounded by the inner side protruding portion and the outer side protruding portion on the end face of the second shielding member 18 is covered with the solid insulating member 9. The insulating member 9 can be arranged in the above way, from the viewpoint of enhancing an effect of suppressing an electric discharge to be generated between the second shielding member 18 and the storage container 1, but the effect of the present invention is obtained, as long as at least the inner side protruding portion and the outer side protruding portion on the end face of the second shielding member 18 are covered with the insulating member 9.

In addition, any method of an anode grounding method and a middle-point grounding method can be adopted as a voltage controlling unit in the radiation generating apparatus of the present invention, but the middle-point grounding method can be adopted. When a voltage applied between the target 14 and the electron-emitting source 11 is represented by Va [V], the anode grounding method is a method of setting the potential of the target 14 which is an anode at a ground (0 [V]), and setting a potential of the electron-emitting source 11 at −Va [V]. On the other hand, the middle-point grounding method is a method of setting a potential of the target 14 with respect to the GND earth at +(Va−α) [V], and a potential of the electron-emitting source 11 with respect to the GND earth at −α [V], respectively, (where Va≥α>0). The value of α is an arbitrary value within a range of $Va \geq \alpha > 0$, but generally is a value close to Va/2. By adopting the middle-point grounding method, the absolute value of the voltage with respect to the ground can be made small, and a creepage distance can be shortened. Here, the creepage distance is a distance between the voltage controlling section 3 and the storage container 1, and a distance between the radiation generating tube 10 and the storage container 1. When the creepage distance can be shortened, the size of the storage container 1 can be reduced, and the weight of the insulating liquid 8 can be reduced by the size reduction. Accordingly, the size and the weight of the radiation generating apparatus can be further reduced.

Exemplary embodiments of a radiation generating apparatus according to the present invention will be shown below.

Exemplary Embodiment 1

In Exemplary Embodiment 1, a radiation generating apparatus of FIGS. 1A and 1B was used. Each member and the radiation generating apparatus are as described above, and accordingly the descriptions are omitted.

In the present exemplary embodiment, an epoxy resin material was selected as a solid insulating member 9, and was fixed on a second shielding member 18 so as to cover the inner side protruding portion and the outer side protruding portion on the end face of the second shielding member 18. The insulating member 9 covered a region surrounded by the inner side protruding portion and the outer side protruding portion on the end face of the second shielding member 18. The thickness of the insulating member 9 on the inner side protruding portion and the outer side protruding portion of the end face of the second shielding member 18 was set in the above described range. An insulating oil formed of a mineral oil was used as an insulating liquid 8. In addition, the middle-point grounding method was adopted as a voltage controlling unit. A tungsten filament was used for the electron-emitting source 11, and was heated by a not-shown heating unit to emit electrons. Thus emitted electrons were subjected to an electron beam trajectory control which used a potential distribution generated by voltage that was applied to an extraction electrode 12 and a lens electrode 13, were accelerated by the voltage Va applied between the electron-emitting source 11 and the target 14 to acquire high energy, and were then collided against a target to generate the radiation there. Tungsten with a thin-film shape was used for a material of the target 14. As for the operating condition of the electron-emitting source 11, a potential of +50 [V] with respect to an electron emitting portion of the electron emitting source was applied to the extraction electrode 12, a potential of 1,000 [V] with respect to the electron emitting portion was applied to the lens electrode 13, and an accelerating voltage Va of 100 [kV] with respect to the electron emitting portion was applied to the target 14. In addition, for the purpose, a potential of the target 14 with respect to a not-shown conducting portion of the storage container 1 was set at +50 [kV], and a potential of the electron-emitting source 11 was similarly set at −50 [kV]. The conducting portion of the storage container 1 was grounded to have a GND potential.

The specific dielectric constant of the epoxy resin material which was used for the solid insulating member 9 of the present exemplary embodiment was 5.0 at 25° C. at 1 MHz, and the resistivity was $1\times10^{12}$ Ωm at 25° C.

The inner side protruding portion of the radiation generating apparatus of the present exemplary embodiment, which annularly surrounded the aperture, had an annular and ridge-shaped cross section, protruded toward the inner wall of the storage container 1, and had a radius of curvature of 28 μm to 52 μm.

The outer side protruding portion of the radiation generating apparatus of the present exemplary embodiment also similarly had an annular and ridge-shaped cross section, protruded toward the inner wall of the storage container 1, and had a radius of curvature of 20 μm to 40 μm.

The radius of curvature was measured through microscopic observation, after the tubular shielding member 18 of the radiation generating apparatus of the present exemplary embodiment was cut so as to contain the axis of the aperture.

The solid insulating member 9 of the present exemplary embodiment covered a range of 228 μm to 52 μm of the inner side protruding portion, and a range of 20 μm to 40 μm of the outer side protruding portion.

The radiation was radiated on the above described conditions while using the radiation generating apparatus of FIGS. 1A and 1B, and the dose of the generated radiation was measured. As a result, it was confirmed that a stable dose of the radiation was obtained. In addition, there was no problem in the electrical voltage withstanding of the radiation generating apparatus. Furthermore, the insulating oil did not cause deterioration as well.

The present inventors assume that the following mechanism works on the driving stability of the radiation generating apparatus, which has been shown in the present exemplary embodiment.

The tubular shielding member 18 is connected to the insulating liquid 9 through the solid insulating member 9; thereby shows an effect of suppressing the exposure of the insulating liquid to a strong electric field region; and also shows an effect of suppressing the production of a cumulative deposition of a foreign matter that is a decomposed product of the insulating liquid 9, which is produced by the deterioration of the insulating liquid due to the denaturation or the like of the insulating liquid caused by a polarization of the insulating liquid, the delivery and receipt of an electric charge and the like under the strong electric field, and which becomes a cause of an electric discharge from the tip of the tubular shielding member 18. Accordingly, the radiation generating apparatus can secure high voltage withstanding properties for a long period of time, and accordingly can achieve higher reliability.

Exemplary Embodiment 2

Figure 2:
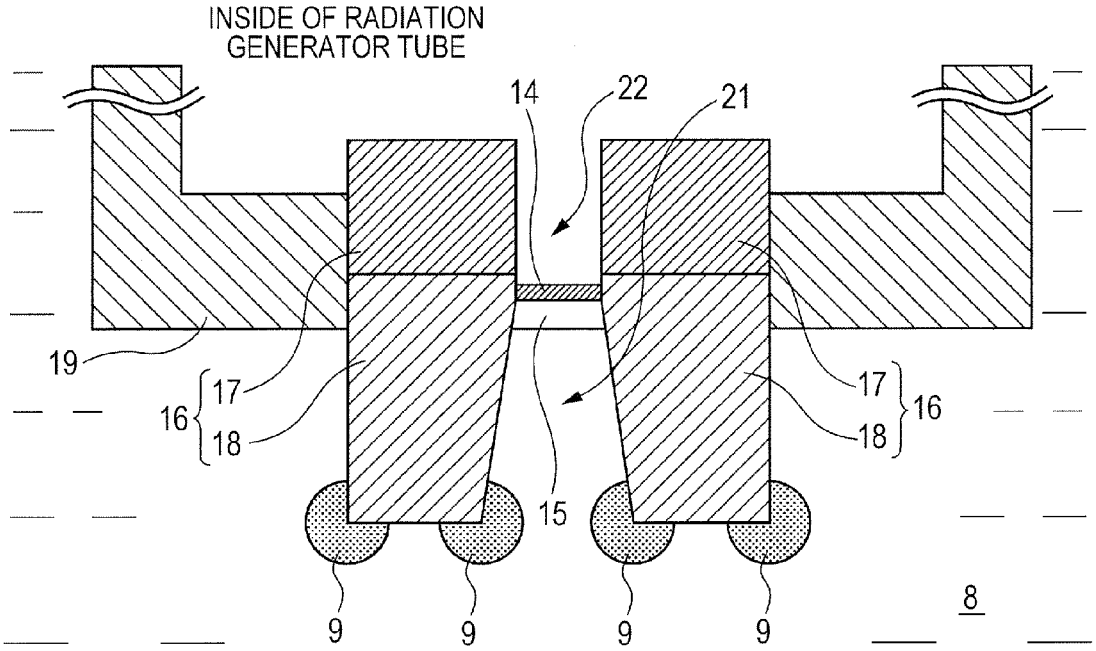
FIG. 2 is a schematic cross-sectional view of a peripheral portion of a shielding member of an embodiment of the present invention.

In Exemplary Embodiment 2, a radiation generating apparatus of FIG. 2 was used. The present exemplary embodiment is different from Exemplary Embodiment 1 in the point that a first insulating member which covers the inner side protruding portion on the end face of the second shielding member 18 and a second insulating member which covers the outer side protruding portion on the end face of the second shielding member 18 are used as a solid insulating member 9. Except this point, the same members and structure of the radiation generating apparatus as in Exemplary Embodiment 1 were used. The thickness of the insulating member 9 on the inner side protruding portion and the outer side protruding portion on the end face of the second shielding member 18 was set in the above described range. The radiation was radiated on similar conditions to those in Exemplary Embodiment 1, while using the radiation generating apparatus of FIG. 2, and the dose of the generated radiation was measured. As a result, it was confirmed that a stable dose of the radiation was obtained. In addition, there was no problem in the electrical voltage withstanding of the radiation generating apparatus. Furthermore, the insulating oil did not cause deterioration as well.

Exemplary Embodiment 3

Figure 3:
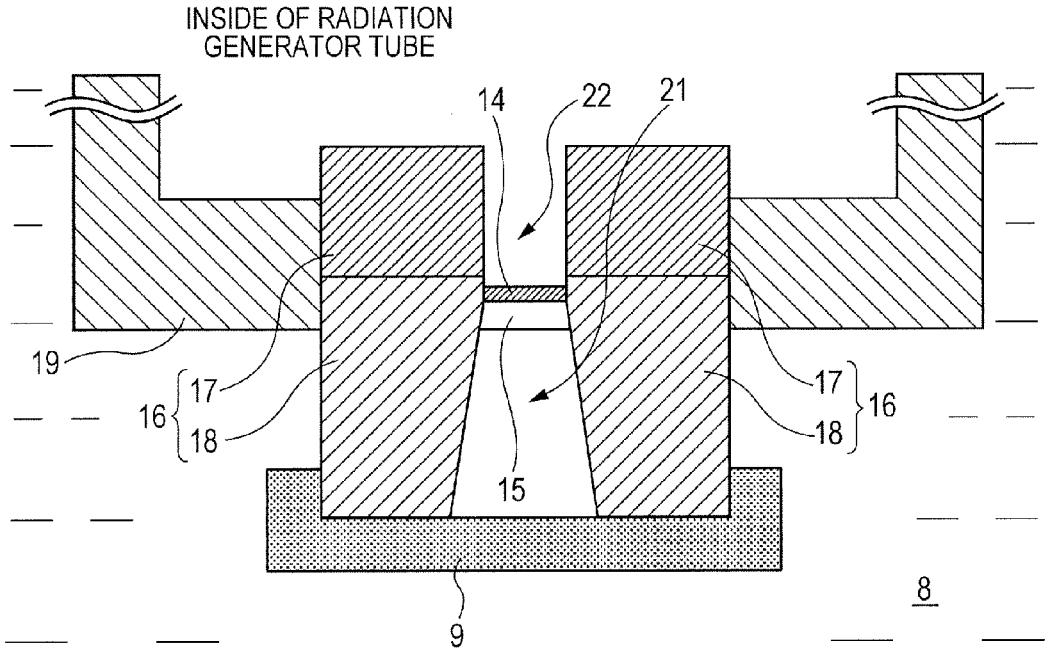
FIG. 3 is a schematic cross-sectional view of a peripheral portion of a shielding member of an embodiment of the present invention.

In Exemplary Embodiment 3, a radiation generating apparatus of FIG. 3 was used. The present exemplary embodiment is different from Exemplary Embodiment 1 in the point that the whole region surrounded by the outer side protruding portion on the end face of the second shielding member 18 is covered with the solid insulating member 9. Except this point, the same members and structure of the radiation generating apparatus as in Exemplary Embodiment 1 were used. The thickness of the insulating member 9 on the inner side protruding portion and the outer side protruding portion on the end face of the second shielding member 18 was set in the above described range. The radiation was radiated on similar conditions to those in Exemplary Embodiment 1, while using the radiation generating apparatus of FIG. 3, and the dose of the generated radiation was measured. As a result, it was confirmed that a stable dose of the radiation was obtained. In addition, there was no problem in the electrical voltage withstanding of the radiation generating apparatus. Furthermore, the insulating oil did not cause deterioration as well. For information, the radiation which has passed through the substrate 15 passes through the insulating member 9, and then is emitted to the outside of the storage container 1 from the first window 2. Accordingly, in order not to reduce the dose of the radiation, the insulating member 9 can have a higher transmissivity of the radiation than a transmissivity of the radiation of the insulating liquid 8.

Exemplary Embodiment 4

Figure 4:
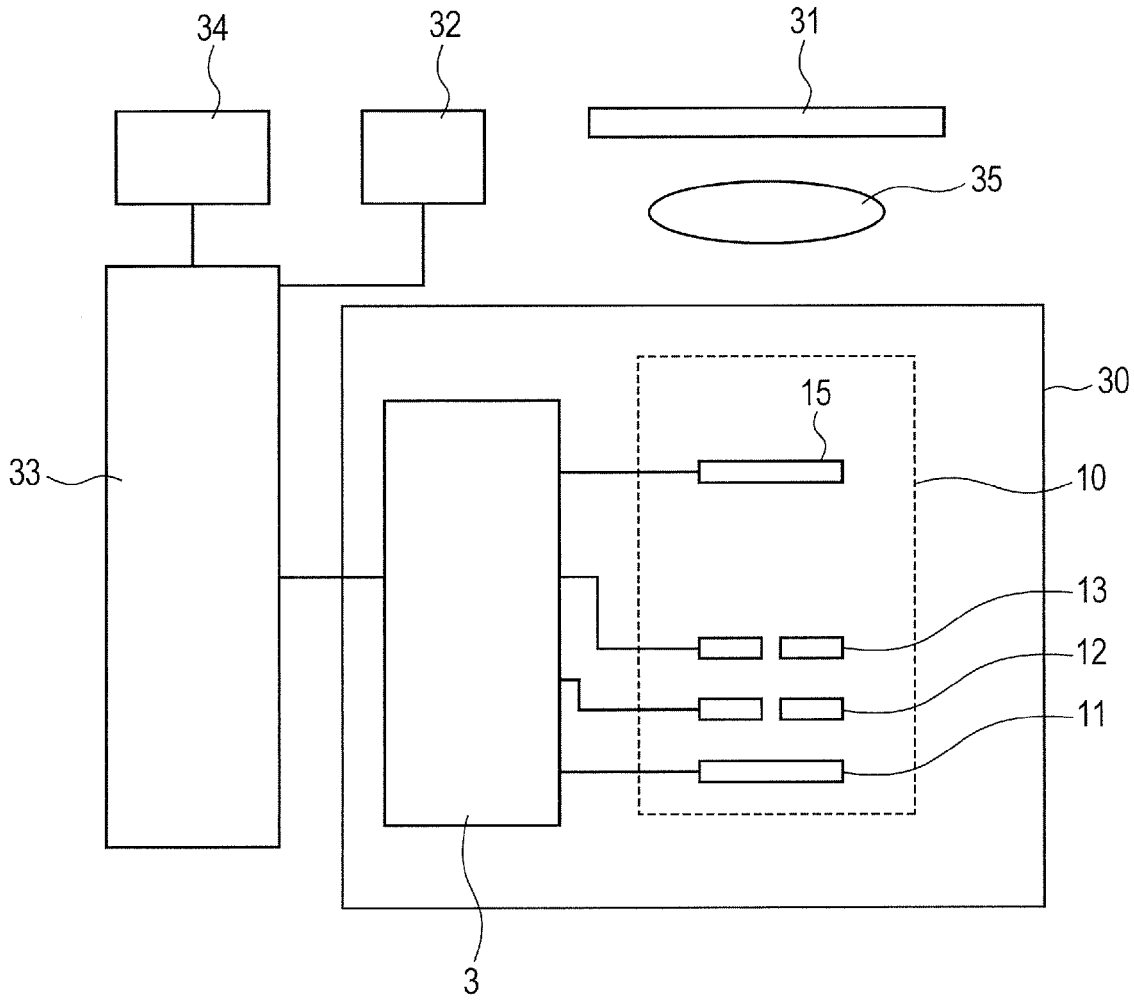
FIG. 4 is a block diagram of a radiation imaging apparatus using the radiation generating apparatus of the present invention.

Next, a radiation imaging apparatus using the radiation generating apparatus of the present invention will be described below with reference to FIG. 4. FIG. 4 is a block diagram of a radiation imaging apparatus of the present exemplary embodiment. The radiation imaging apparatus of the present exemplary embodiment includes a radiation generating apparatus 30, a radiation detector 31, a signal processing section 32, a device controlling section 33, and a display 34. The radiation generating apparatuses of Exemplary Embodiment 1 to 3, for instance, can be used as the radiation generating apparatus 30. The radiation detector 31 is connected to the device controlling section 33 through the signal processing section 32, and the device controlling section 33 is connected to the display 34 and a voltage controlling section 3. The processing in the radiation generating apparatus 30 is collectively controlled by the device controlling section 33. The device controlling section 33, for instance, controls radiation imaging with the use of the radiation generating apparatus 30 and the radiation detector 31. The radiation which has been emitted from the radiation generating apparatus 30 is detected by the radiation detector 31 through an object 35, and a radiation-transmission image of the object 35 is taken. The taken radiation-transmission image is displayed on the display 34. In addition, the device controlling section 33, for instance, controls the driving of the radiation generating apparatus 30, and controls a voltage signal applied to the radiation generating tube 10 through the voltage controlling section 3. For information, in FIG. 4, an insulating liquid stored in the storage container 1 as well as the radiation generating tube 10 and the voltage controlling section 3 is not illustrated for simplification.

An object was radiation-imaged by using the radiation imaging apparatus of the present exemplary embodiment and by setting Va at 100 kV, and as a result, an adequate image could be obtained without causing a problem in electrical voltage withstanding.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-152792, filed Jul. 11, 2011, which is hereby incorporated by reference herein in its entirety.

What is claimed is:

1. A radiation generating apparatus comprising:

a radiation generating tube having a target, a tubular shielding member for shielding a part of radiation generated from the target, and having an aperture through which the radiation passes, and an envelope holding the tubular shielding member with a portion of the tubular shielding member protruding externally from the envelope; and a container holding the radiation generating tube therein, and an insulating liquid contacting the tubular shielding member and the container, wherein the protruding portion of the tubular shielding member is covered with a solid electrically insulating member, wherein the tubular shielding member has at least an inner side protruding portion and an outer side protruding portion, such that a distance from the inner side protruding portion to the aperture is different from a distance from the outer side protruding portion to the aperture, the inner side protruding portion is closer to the aperture than the outer side protruding portion, and the solid electrically insulating member covers one of the inner side protruding portion and the outer side protruding portion, and wherein the solid electrically insulating member covers both of the inner side protruding portion and the outer side protruding portion.

2. The radiation generating apparatus according to claim 1, wherein the protruding portion has a radius of curvature equal to or smaller than 100 μm.

3. The radiation generating apparatus according to claim 1, wherein the container has a window in opposition to the aperture, and the protruding portion is arranged such that a distance between the protruding portion and the container is shorter than the protruding portion and a position at which bisector of an angle of the protruding portion intersects the container.

4. The radiation generating apparatus according to claim 1, wherein the protruding portion is annular in shape and surrounds the aperture.

5. The radiation generating apparatus according to claim 4, wherein the solid electrically insulating member is annular in shape and annularly covers the annular protruding portion.

6. The radiation generating apparatus according to claim 1, wherein the insulating liquid is an electrically insulating oil containing at least any one of silicone oil and perfluoro-series polymer oil.

7. The radiation generating apparatus according to claim 1, wherein the solid electrically insulating member has a resistivity larger than that of the insulating liquid.

8. The radiation generating apparatus according to claim 1, wherein the solid electrically insulating member has a specific dielectric constant smaller than that of the insulating liquid.

9. The radiation generating apparatus according to claim 1, wherein the solid electrically insulating member is formed from epoxy resin.

10. The radiation generating apparatus according to claim 3, wherein the solid electrically insulating member is placed between the aperture and the window.

11. The radiation generating apparatus according to claim 1, wherein the solid electrically insulating member is placed to cover the aperture.

12. The radiation generating apparatus according to claim 1, wherein the radiation generating tube has an electron emitting source within the envelope, and wherein the electron emitting source is arranged in opposition to the target which generates radiation in response to an irradiation with an electron emitted from the electron source.

13. The radiation generating apparatus according to claim 1, wherein the target is connected to the aperture.

14. The radiation generating apparatus according to claim 12, further comprising a voltage controlling unit for setting a potential of the target in relation to a ground voltage at $+(V_a-\alpha)$ [V], and for setting a potential of the electron emitting source in relation to the ground voltage at $-\alpha$ [V], wherein $V_a \geq \alpha > 0$.

15. A radiation imaging apparatus comprising:

the radiation generating apparatus according to claim 1; and a radiation detector for detecting the radiation being emitted from the radiation generating apparatus and passing through an object.

* * * * *